United States Patent [19]

Wang et al.

[11] Patent Number: 4,828,655

[45] Date of Patent: May 9, 1989

[54] METHOD OF FORMING MOLYBDENUM/IRON PHOSPHATE SURFACE COATING MATERIAL

[75] Inventors: Su-Chee S. Wang, Sterling Heights; Simon C. Tung, Rochester, both of Mich.

[73] Assignee: General Motors Corporation, Detroit, Mich.

[21] Appl. No.: 157,473

[22] Filed: Feb. 18, 1988

[51] Int. Cl.[4] ..... C25D 11/00; C25D 11/36; C25D 5/00

[52] U.S. Cl. ..... 204/38.1; 204/38.4; 204/56.1; 204/58.5; 204/147; 427/38

[58] Field of Search ..... 427/38, 404, 405; 204/38.1, 38.4, 14.1, 56.1, 58.5, 147, 148, 196, 197

[56] References Cited

U.S. PATENT DOCUMENTS

| | | | |
|---|---|---|---|
| 870,937 | 11/1907 | Coslett | 204/56.1 |
| 2,927,068 | 3/1960 | Marsh et al. | 204/147 |
| 3,262,867 | 7/1966 | Callahan | 204/56.1 |
| 3,409,525 | 11/1968 | Taylor et al. | 204/147 |
| 3,479,260 | 11/1969 | Rauch et al. | 204/56.1 |
| 3,484,344 | 12/1969 | Spiller | 204/56.1 |
| 4,522,892 | 6/1985 | Shindow et al. | 204/56.1 |
| 4,714,529 | 12/1987 | Wang et al. | 204/56.1 |

OTHER PUBLICATIONS

Some Factors Affecting the Decomposition of Three Commercial Zinc Organodithiophosphates, by Fred G Rounds, ASLE Transactions, vol. 18, 2 pp. 79–89, 1973.

Additive Interactions and Their Effect on the Performance of a Zinc Dialkyl Dithiophosphate, by Fred G. Rounds, ASLE Transactions, vol. 21, 2, pp. 91–101, 1976.

Pitting and Deposits with an Organic Fluid by Electrolysis and by Fluid Flow, by T. R. Beck, D. W. Mahaffey, and J. H. Olsen, J. Electrochem. Soc., Feb. 1972, pp. 155–160.

Effects of Additive on the Friction of Steel on Steel, by Fred G. Rounds, ASLE Transactions 7, 11–23 (1964).

General Motors Engineering Standards, GM 4277-M, Anti-Friction Finish-Phosphate Type, pp. 43, 101, Nov. 1979, Dec. 1984, pp. 43.201–43.203.

Metals Handbook, Nonmetallic Coating Processes, pp. 531–547.

"Electrophysical and Electrochemical Phenomena in Friction Cutting, and Lubrication", by S. N. Postnikov, pp. 93, 111–113, Dec. 1969.

*Primary Examiner*—John F. Niebling
*Assistant Examiner*—Ben C. Hsing
*Attorney, Agent, or Firm*—Randy W. Tung

[57] ABSTRACT

A method of using an electrochemical process in oil-based lubricants to form friction-reducing and wear-reducing molybdenum/iron phosphate films on cast iron surfaces. A cast iron surface acting as the anode means is first coated with a thin film of molybdenum and then bombarded with high energy inert gas ions to form a layer of molybdenum/iron alloy on the surface before the electrochemical process. An electrolytic additive of dialkyl hydrogen phosphate is added to the oil-based lubricant to improve its electrical conductance and to make it an ionic conductor. This method enables not only the formation of uniform molybdenum-/iron phosphate films on cast iron surfaces but also the in situ repair of such films after damage has occurred.

5 Claims, 3 Drawing Sheets

METHOD OF FORMING MOLYBDENUM/IRON PHOSPHATE SURFACE COATING MATERIAL

FIELD OF THE INVENTION

This invention generally relates to a method of forming friction-reducing and wear-reducing molybdenum-/iron phosphate films on metal surfaces immersed in an oil-based lubricant and, more particularly, is concerned with the method of using an electrical potential in oil-based lubricants containing a dialkyl hydrogen phosphate additive to form molybdenum/iron phosphate films on metal surfaces that are precoated with molybdenum and bombarded with inert gas ions.

BACKGROUND OF THE INVENTION

In the automotive industry, engine friction and wear reduction by adding additives to an oil-based lubricant is one of the most appealing approaches for improving vehicle fuel economy. The potential benefits realizable from this technique can be readily applied to all vehicles at low cost. Additives have been added to oil-based lubricants to reduce friction and wear by creating chemical reactions between the additives and the metal surfaces. However, these chemical reactions are very slow and the reaction films thus formed are generally not uniform. It has also been proposed that metal surfaces may be coated with friction-reducing or wear-reducing films before they are assembled into a vehicle. However, the durability of these films is less than desirable and it is extremely difficult to repair damaged films after a vehicle has been assembled and operated.

The formation of wear-reducing films on metal surfaces immersed in aqueous solutions or molten slats by an electrochemical technique has been performed by others. Great difficulties were encountered when the same electrochemical technique was used in a process to form friction-reducing and wear-reducing films on metal surfaces immersed in oil-based lubricants. Since oil-based lubricants have extremely high electrical resistance, electrical current cannot pass through the lubricants.

In our previous U.S. Pat. No. 4,714,529 issued Dec. 22, 1987, an electrolytic additive of dialkyl hydrogen phosphate was added to an oil-based lubricant and iron phosphate films were formed on cast iron surfaces. However, the durability of these films formed was found to be inadequate in motor vehicle engine applications.

It is therefore an object of the present invention to provide a method of coating metal surfaces immersed in oil-based lubricants with a friction-reducing and wear-reducing film that has improved durability.

It is another object of the present invention to provide a method of coating metal surfaces immersed in oil-based lubricants with a durable friction-reducing and wear-reducing film electrochemically by pretreating the metal surface with a molybdenum film and bombarding the surface with inert gas ions.

SUMMARY OF THE INVENTION

A cast iron surface is first cleaned by an oxygen plasma for five minutes to eliminate all the contaminants. A film of molybdenum having a thickness of approximately 30 nanometers is then coated on the cast iron surface by a vapor deposition method. The molybdenum and the iron substrate are then mixed together by bombarding the iron surface with 200 keV krypton ions to form an Fe-Mo alloy on the surface. This Fe-Mo alloy coated cast iron surface is then subjected to an electrochemical process immersed in an oil-based lubricant to convert the iron particles into iron phosphate.

We have discovered that in order to coat metal surfaces immersed in oil-based lubricants with a friction-reducing and wear-reducing film and to make in situ repair of such films possible, an electrochemical process rather than a chemical process must be utilized. An added benefit of the electrochemical process is that films of more uniform and greater thickness may be formed.

In order to apply the electrochemical process to form friction-reducing and wear-reducing film on metal surfaces immersed in oil-based lubricants, the lubricant must first become a component of the electrochemical system, i.e. an ionic conductor. Since oil-based lubricants have extremely high electrical resistance, electrolytic additives must be blended into the oil-based lubricants at a desirable concentration to reduce the electrical resistance and to improve the electrical conductance. Stable open-circuit potential readings are thus obtained and electrical current is passed between the metal surfaces.

We have discovered that suitable electrolytic additives for our oil-based lubricants are dialkyl hydrogen phosphates, specifically, dilauryl hydrogen phosphate (DHP) and mixed-alkyl acid orthophosphate. For instance, friction-reducing and wear-reducing iron phosphate films were detected on surfaces of cast iron electrodes after immersion in an oil-based lubricant containing 2.5 wt. % dilauryl hydrogen phosphate and after being subjected to electrolysis. This suggests that the formation of a uniform friction-reducing and wear-reducing film and in situ repair of damaged films on sliding surfaces are possible.

BRIEF DESCRIPTION OF THE DRAWINGS

Other objects, features and advantages of the present invention will become apparent upon consideration of the specification and the appended drawings, in which.

DETAILED DESCRIPTION OF A PREFERRED EMBODIMENT

Figure 1:
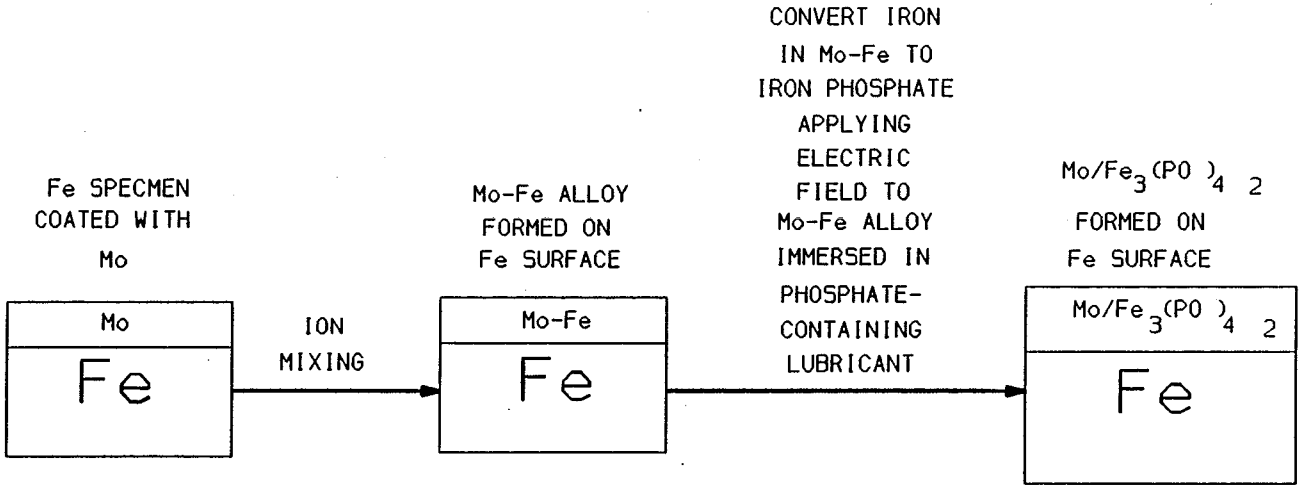
FIG. 1 is a schematic diagram showing a flow chart of the surface coating process.

The reduction of engine friction through lubricant modification is one of the most appealing approaches for improving vehicle fuel economy because the technique can be readily applied to all vehicles at low cost. Our previous work has shown that additive interaction with lubricated sliding surfaces plays an important role in the reduction and control of friction and wear. It is known that additives used to reduce friction and wear are usually long straight-chain organic molecules having a polar group at one end. The magnitude of the polarity is an important factor in its performance in reducing friction.

We have discovered that in order to coat metal surfaces immersed in oil-based lubricants with a friction-reducing and wear-reducing film of sufficient thickness in a relatively short period of time, an electrochemical process rather than a chemical process must be utilized. Additional benefits of using the electrochemical process are films of more uniform and greater thickness may be formed and that in situ repair of these friction-reducing and wear-reducing films may be possible.

It is commonly believed that oil-based lubricants are insulators rather than ionic conductors and therefore they are poor components for electrochemical systems. We have discovered that in order to apply an electrochemical technique to the formation of friction-reducing and wear-reducing films on metal surfaces immersed in an oil-based lubricant, the lubricant must first become a component of the electrochemical system, i.e. an ionic conductor.

As one of the novel features of our invention, dialkyl hydrogen phosphates, specifically dilauryl hydrogen phosphate and mixed-dialkyl acid orthophosphate, are used to change the ionic character of the oil-based lubricant. For instance, friction-reducing and wear-reducing iron phosphate films of sufficient thickness are formed on surfaces of cast iron electrodes after immersion in an oil-based lubricant containing 2.5 wt. % dilauryl hydrogen phosphate and after being subjected to electrolysis.

Another novel feature of our invention is that in order to significantly improve the durability of the iron phosphate film formed, we have used a process of precoating the cast iron surface with a thin film of molybdenum. In this precoating process, a cast iron surface is first cleaned by oxygen plasma for five minutes to eliminate all impurities and contaminants. A thin film of approximately 30 nanometers thick of molybdenum is then coated on the cast iron surface by a vapor deposition method. This type of vapor deposition method is well described in the chemical literature, e.g. VLSI Technology, edited by S. M. Sze, published 1983, p. 350 to p. 353. We believe that a minimum thickness of molybdenum coating required is approximately 10 to 15 nanometers. In the next step of the precoating process, the molybdenum and the iron particles are mixed together in the surface layer of the cast iron specimen by bombarding the surface with 200 keV krypton (Kr) ions at a dosage rate of $5\times10^{16}$ Kr ions/cm$^2$. After the bombardment, an iron/molybdenum alloy is formed on the surface of the cast iron specimen. We have reason to believe that other inert gas ions of similar or larger particle size such as argon, xenon, and radon should work equally well in place of krypton.

For the bombardment method, we used an equipment made by Varian/Extrion, Model CF 3000. A maximum energy of 200 keV was applied to the krypton ions. The equipment is normally used for the processing of silicon wafers, but we found that it is easily adapted for our surface modification purpose. Our precoating process is shown in FIG. 1 as step 1 and step 2 schematically in a flow chart. Step 3 illustrates the electrochemical process that follows the coating and the mixing processes.

The lubricant used in our invention is a blend of a base stock, CITGO 90105, mineral oil and an additive of dilauryl hydrogen phosphate (DHP). The additive dilauryl hydrogen phosphate used in our invention is of reagent grade obtained from the Mobil Corporation.

Figure 2:
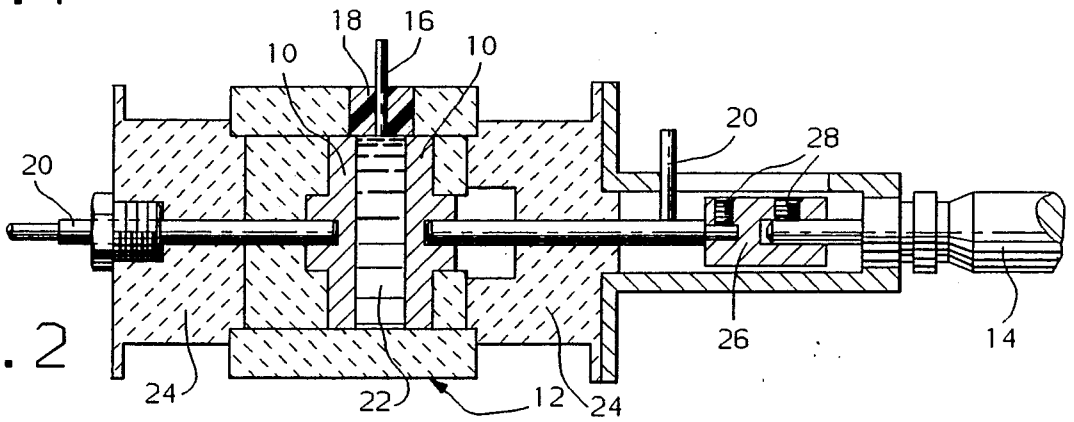
FIG. 2 is a schematic diagram of the electrochemical charging cell.

Referring now to FIG. 2, an electrochemical cell composed of two iron electrodes 10 embedded in a ceramic sleeve 12 is shown. The purpose of the ceramic sleeve 12 is to help maintain lubricant between the electrodes 10 and to maintain uniform current distribution. Since the electrical conductivity of lubricant systems in general is extremely low, i.e. smaller than $10^{-10}$ (ohms-cm)$^{-1}$, the two electrodes 10 have to be very closely spaced to each other in order to lower the ohmic resistance. A micrometer 14 is used to control the distance between electrodes 10. We have found a suitable distance to be used is 0.015 cm. The micrometer 14 is connected to one of the electrodes through insulating block 26 and set screws 28.

The cast iron electrodes 10 in FIG. 2 are of 1" diameter. One of the two electrodes was used as the anode, and the other was used as the cathode. The choice was arbitrary. The roughness of the electrodes was grounded to less than 1 micron. We have found that the thickness of the electrodes is not critical Before the electrolysis, the electrodes 10 were rinsed with acetone to remove grease on the surfaces.

Cast iron electrode leads 20 (FIG. 2) are made of stainless steel to collect current passing through the electrodes 10 and the lubricant 22 contained in ceramic sleeve 12. The size of the leads is not critical because of the extremely small amount of current passing through it. Two ceramic blocks 24 are used to insulate the two cast iron electrodes 10 from the container (not shown) of the electrochemical cell which is made of stainless steel. All tests were conducted at 23° C. Our test lubricant is prepared by mixing 97.5 grams of CITGO 90105 mineral oil with 2.5 grams of DHP.

The electrode surfaces were analyzed using scanning electron spectroscopy, back scattered electron spectroscopy, Auger Electron Spectroscopy (AES), electron spectroscopy for chemical analysis and X-ray diffraction. The lubricants were also analyzed by infrared spectroscopy, and nuclear magnetic resonance.

Two cast iron electrodes 10 (FIG. 2) mounted in an electrochemical cell were galvanostatically polarized at a current of 0.05 micro-amp. After passing 108 micro-Coulomb of charge, the electrodes were removed for analysis. In order to identify the films, both the anode and the cathode were analyzed by the Auger Electron Spectroscopy (AES).

We have used a current density of 0.05 micro-amp/cm$^2$ in the formation of iron phosphate film on the surface of 1 inch diameter iron electrodes in our novel process. Our experimental data indicated that any current density within the range of 0.001 micro-amp/cm$^2$ to 1000 micro-amp/cm$^2$ should work equally well. The current density to be used is determined by the length of the charge time desired, i.e. the smaller the current density, the longer the charge time required. We have also found that at a current density of 0.05 micro-amp/cm$^2$, a total charge time of approximately 36 minutes is required to form an iron phosphate film of 150 nanometers thick.

We have also used other dialkyl hydrogen phosphates as the electrolytic additive in our oil-based lubricants to form friction-reducing and wear-reducing films. For instance, a mixed-dialkyl acid orthophosphate commercially available from DuPont under the tradename of Ortholeum 162 was successfully used to form iron phosphate films in our oil-based lubricants.

We have also found that a broad percentage range of the dialkyl hydrogen phosphate can be used as our electrolytic additive, i.e. between 0.1 to 99 weight percent.

Figure 3:
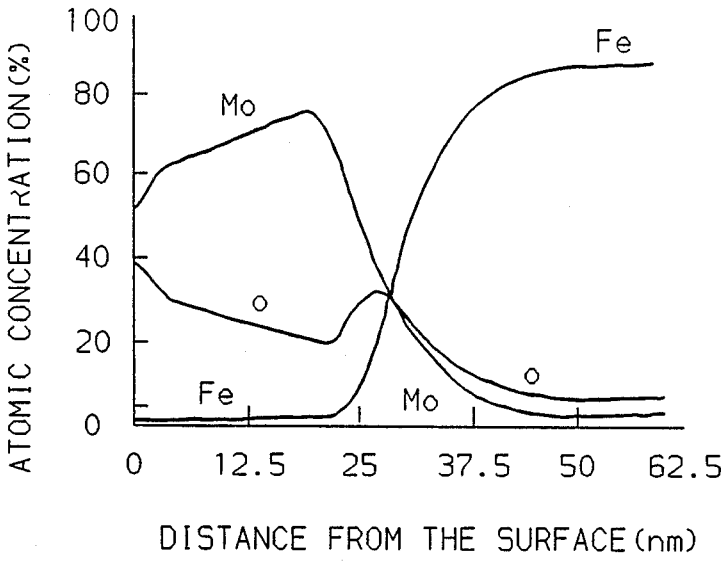
FIG. 3 is a graph showing the atomic concentration on a cast iron specimen after step 1, the molybdenum coating process, obtained by Auger Electron Spectroscopy.

After the step 1 process, the cast iron surface coated with 30 nanometers thick molybdenum was examined by Auger Electron Spectroscopy. A depth profile obtained by the Auger Electron Spectroscopy is shown in FIG. 3 which confirms the thickness of the molybdenum coated. In the depth profile of FIG. 3, oxygen is also observed. We believe that it is oxygen originated from the oxygen plasma cleaning process conducted prior to molybdenum deposition.

Figure 4:
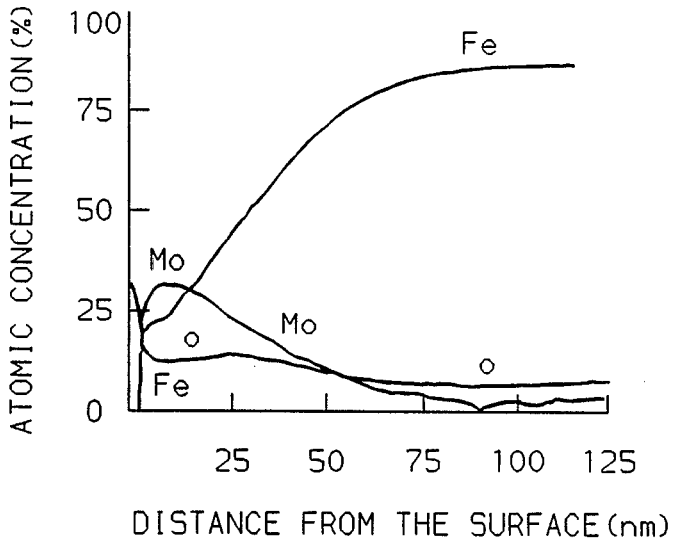
FIG. 4 is a graph showing the atomic concentration on a cast iron specimen after step 2, the iron mixing step, obtained by Auger Electron Spectroscopy.

After the step 2 ion mixing process, the cast iron surface was examined again under the Auger Electron Spectroscopy. A quite different depth profile is obtained as shown in FIG. 4. It is seen that iron has moved toward the surface while molybdenum has penetrated deeper into the substrate to a depth of more than 60 nanometers. Even though iron has not migrated all the way to the surface, a partial mixing was accomplished by the krypton ion bombardment.

Figure 5:
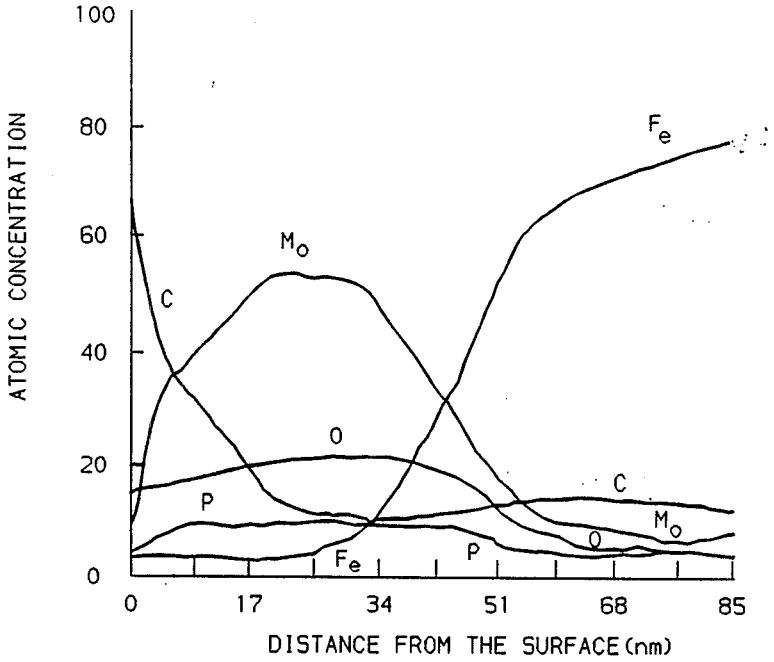
FIG. 5 is graph showing the atomic concentration on a cast iron specimen after step 3, the electrochemical process, obtained by Auger Electron Spectroscopy.

After step 3, the electrochemical process, a depth profile by the Auger Electron Spectroscopy is again obtained on the cast iron surface. This is shown in FIG. 5. The appearance of phosphorus and oxygen in the depth profile is evidence of the formation of iron phosphate on the specimen surface. When compared to FIG. 4, FIG. 5 shows lower iron concentration near the surface of the specimen. Since an accelerated corrosion reaction occurs during the electrochemical process, we believe that iron atoms located near the surface of the specimen could have been etched away. The observation of carbon in FIG. 5 implies a possible hydrocarbon dispersion in the inorganic iron phosphate structure.

Figure 6:
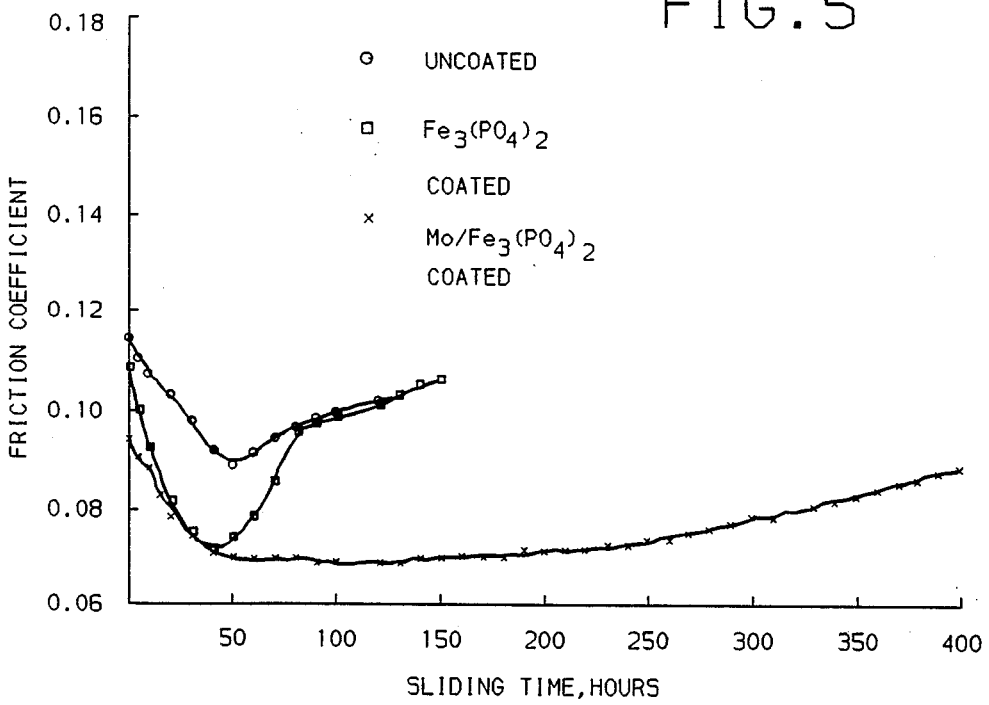
FIG. 6 is a graph showing the friction-reducing effect of a molybdenum/iron phosphate film formed on the cast iron surface by the electrochemical process.

In a commercial SAE 30 engine oil, the molybdenum-/iron phosphate coating provides excellent results in reducing friction. This is shown in FIG. 6. The friction coefficient for molybdenum/iron phosphate coated specimens remains within a range from 0.070 to 0.074 for at least 300 hours. Even after 400 hours of sliding motion, the friction coefficient for molybdenum/iron phosphate coated specimens is still as low as 0.087. In contrast, the friction coefficient for an iron phosphate coated specimen started to increase after 50 hours due to the wear of the surface coating and the friction coefficient becomes identical to that for uncoated specimens after 80 hours. These results demonstrate that even under severe test conditions, molybdenum/iron phosphate films are at least six times more durable than the iron phosphate film. These results suggest that molybdenum/iron phosphate film is a promising coated material for motor vehicle applications such as in piston rings and other moving components in reducing engine friction. Furthermore, in situ repair of damaged films on sliding metal surfaces is also possible by charging the system periodically during the operation of the system. For instance, this technique may be applied to the in situ repair of molybdenum/iron phosphate films formed between sliding components in an internal combustion engine, i.e. the piston ring and the cylinder surface.

It should be noted that even though our tests were conducted on molybdenum coated specimens bombarded with krypton ions at a maximum power level of 200 keV, we have reason to believe that ions of other inert gases having similar or larger particle sizes such as argon, xenon and radon should function equally well at power levels between 50 keV to 5000 keV. For ions such as argon, which have a smaller particle size, a higher power level than 200 keV is necessary. For ions having larger particle sizes such as xenon and radon, a lower power level than 200 keV may be utilized.

While our invention has been described in terms of one preferred embodiment thereof, it is to be appreciated that those skilled in the art will readily apply these teachings to other possible variations of the invention.

The embodiments of the invention in which an exclusive property or privilege is claimed are defined as follows:

1. In a method of forming a friction-reducing and wear-reducing film on the surface of a cast iron anode means spaced apart from a cathode means both immersed in an oil-based lubricant by an electrochemical process comprising the steps of blending an electrolytic additive of a dialkyl hydrogen phosphate into said oil-based lubricant such that sufficient electrical current passes in said lubricant and passing an electrical current of sufficient current density between said anode and cathode means whereby friction-reducing and wear-reducing films are formed on the surface of said anode means, the improvement comprises first precoating the surface of said cast iron anode means with molybdenum and then bombarding the surface with inert gas ions prior to submitting said anode means to said electrochemical process such that a molybdenum/iron phosphate film is formed on said anode means.

2. A method of forming a friction-reducing and wear-reducing film on the surface of a cast iron anode means spaced apart from a cathode means both immersed in an oil-based lubricant by an electrochemical process, comprising the steps of coating the surface of the anode means with molybdenum and bombarding said coated surface with inert gas ions prior to immersing said anode means into said oil-based lubricant, blending an electrolytic additive of a dialkyl hydrogen phosphate into said oil-based lubricant such that sufficient electrical current passes in said lubricant, passing an electrical current of sufficient current density between said anode and cathode means whereby a friction-reducing and wear-reducing film is formed substantially of molybdenum/iron phosphate on the surface of said anode means.

3. A method of forming a friction-reducing and wear-reducing film on the surface of a cast iron anode means spaced apart from a cathode means both immersed in an oil-based lubricant by an electrochemical process comprising the steps of coating the surface of said anode means with molybdenum and bombarding said coated surface with inert gas ions prior to immersing said anode means into said oil-based lubricant, blending a suitable amount of an electrolytic additive of a dialkyl hydrogen phosphate selected from the group consisting of dilauryl hydrogen phosphate and mixed-dialkyl acid orthophosphate into said oil-based lubricant such that sufficient electrical current passes in said lubricant, passing an electrical current of sufficient magnitude between said anode and cathode means for a sufficient length of time whereby a friction-reducing and wear-reducing film is formed substantially of molybdenum/iron phosphate on the surface of said anode means.

4. A method of forming a friction-reducing and wear-reducing film on the surface of a cast iron anode means spaced apart from a cathode means both immersed in an oil-based lubricant by an electrochemical process comprising the steps of coating the surface of said anode means with molybdenum and bombarding said coated surface with inert gas ions prior to immersing said anode means into said oil-based lubricant, blending between 0.1 to 99 weight percent of an electrolytic additive of a dialkyl hydrogen phosphate selected from the group consisting of dilauryl hydrogen phosphate and mixed-dialkyl acid orthophosphate into said oil-based lubricant such that sufficient electrical current passes in said lubricant, passing an electrical current having a current density between 0.001 to 1000 micro-amp/$cm^2$ between said anode and cathode means for a sufficient length of time whereby a friction-reducing and wear-reducing film is formed substantially of molybdenum/iron phosphate on the surface of said anode means.

5. A method of forming a friction-reducing and wear-reducing film on the surface of an anode means spaced apart from a cathode means both immersed in an oil-based lubricant by an electrochemical process comprising the steps of coating the surface of said anode means with molybdenum to a thickness no less than 10 nanometers and bombarding said coated surface with krypton ions prior to immersing said anode means into said oil-based lubricant, blending between 1 to 5 weight percent of an electrolytic additive of a dialkyl hydrogen phosphate selected from the group consisting of dilauryl hydrogen phosphate and mixed-dialkyl acid orthophosphate into said oil-based lubricant such that sufficient electrical current passes in said lubricant, passing an electrical current having a current density between 0.01 to 100 micro-amp/$cm^2$ between said anode and cathode means for a period of time between 200 to 1 minutes whereby a friction-reducing and wear-reducing film is formed substantially of molybdenum/iron phosphate on the surface of said anode means.

* * * * *